US009423743B2

(12) United States Patent
Yamada et al.

(10) Patent No.: US 9,423,743 B2
(45) Date of Patent: Aug. 23, 2016

(54) UNIT CHECKING DEVICE, UNIT, AND IMAGE FORMING APPARATUS

(71) Applicant: KONICA MINOLTA, INC., Chiyoda-ku, Tokyo (JP)

(72) Inventors: Yohei Yamada, Hino (JP); Mikiyuki Aoki, Toyohashi (JP); Toru Kasamatsu, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/002,110

(22) Filed: Jan. 20, 2016

(65) Prior Publication Data

US 2016/0209793 A1 Jul. 21, 2016

(30) Foreign Application Priority Data

Jan. 20, 2015 (JP) ..... 2015-008889

(51) Int. Cl.
*G03G 15/00* (2006.01)

(52) U.S. Cl.
CPC ..... *G03G 15/50* (2013.01); *G03G 2221/1823* (2013.01); *G03G 2221/1892* (2013.01)

(58) Field of Classification Search
CPC ..... G03G 2221/1892; G03G 2221/1823; G03G 15/00
USPC ..... 399/12, 13
See application file for complete search history.

(56) References Cited

U.S. PATENT DOCUMENTS

2002/0164169 A1* 11/2002 Arai ..... B41J 2/17546 399/12
2011/0182594 A1* 7/2011 Arai ..... G03G 15/5004 399/12

FOREIGN PATENT DOCUMENTS

JP 06051585 A 2/1994
JP 10240068 A 9/1998
JP 2005195979 A 7/2005

* cited by examiner

*Primary Examiner* — Hoang Ngo
(74) *Attorney, Agent, or Firm* — Holtz, Holtz & Volek PC

(57) ABSTRACT

A unit checking device is provided which checks whether a unit detachably provided to a device body is new or old. The unit checking device includes a transistor for checking provided in the unit and configured to be destructed by power supplied from the device body; and an inspection device provided in the device body and configured to determine whether or not the transistor is destructed by applying a voltage to the transistor.

16 Claims, 10 Drawing Sheets

UNIT CHECKING DEVICE, UNIT, AND IMAGE FORMING APPARATUS

This application is based on Japanese patent application No. 2015-008889 filed on Jan. 20, 2015, the contents of which are hereby incorporated by reference.

BACKGROUND OF THE INVENTION

1. Field of the Invention

The present invention relates to a unit checking device for checking whether a unit detachably provided to a device body is new or old, such a unit, and an image forming apparatus.

2. Description of the Related Art

In an image forming apparatus such as a printer, a copier, a multi-functional device, or a facsimile machine, for easy maintenance, a mechanism with a member which is relatively easily deteriorated and a container for a color material are provided as detachable units. A user or a service person replaces units in a timely manner to keep the mechanism performance good and to replenish the color material which is a consumable item.

The image forming apparatus determines, when a unit is attached (mounted) thereto, whether the unit is a brand-new unit having never been attached before or an old unit (secondhand unit). If the unit is determined to be a new unit, then the image forming apparatus performs, for example, various adjustments depending on the performance of the new member. The image forming apparatus then applies processing to the attached unit determined to be "new" in such a manner that the attached unit is handled as an "old unit" from now on.

There has been a technology for using a fuse to determine whether a unit is new or old (Japanese Unexamined Patent Application Publication No. 6-51585). According to the publication, the fuse is provided to a unit. When the unit is attached to an image forming apparatus, one end of the fuse is connected to the power source of the main body of the image forming apparatus, and an electric potential of the other end of the fuse is detected. The potential of the other end is equal to a potential of the power source when a fuse blowout is not caused. In such a case, the image forming apparatus determines that the unit is new, and then, a high-current is supplied to the fuse to cause a fuse blowout.

Another technology has been proposed in which a zener diode rather than a fuse is provided to a unit (Japanese Unexamined Patent Application Publication No. 10-240068). According to the publication, a potential of a cathode is detected while a predetermined voltage is applied to the zener diode. The potential of the cathode is equal to a predetermined potential corresponding to a breakdown voltage in a case where the zener diode is not broken. In such a case, the image forming apparatus determines that the unit is new, and then, a high-current equal to or greater than a rated current is supplied to the zener diode to break the zener diode.

In the foregoing conventional technologies, supplying a current to cause a fuse blowout or to break the zener diode is processing based on which a determination that a unit is old can be made.

Where a fuse or a zener diode is used for determination as to whether a unit is new or old, supplying a high-current equal to or greater than several hundreds of milliamperes is required to cause a fuse blowout or to break the zener diode. Therefore, it is necessary to use a switching element having a current capacity equal to or greater than the high-current to turn ON/OFF energization. A switching element having a large current capacity is large compared to that having a small current capacity. This causes a problem that a space large enough to mount such a large switching element has to be provided on a circuit board. The problem makes it difficult to reduce a space for the device body (to downsize the device body) to which the unit is attached and to reduce the cost of the device body.

There is also another problem that the fuse and the zener diode by themselves are expensive compared to the other circuit components. This makes it difficult to reduce the cost of the unit.

SUMMARY

The present disclosure has been achieved in light of such a problem, and therefore, an object of an embodiment of the present invention is to reduce a current capacity of an element necessary to control energization for checking whether a unit is new or old.

A unit checking device according to an aspect of the present invention is a unit checking device for checking whether a unit detachably provided to a device body is new or old. The unit checking device includes a transistor for checking provided in the unit and configured to be destructed by power supplied from the device body; and an inspection device provided in the device body and configured to determine whether or not the transistor is destructed by applying a voltage to the transistor.

These and other characteristics and objects of the present invention will become more apparent by the following descriptions of preferred embodiments with reference to drawings.

DESCRIPTION OF THE PREFERRED EMBODIMENTS

Figure 1:
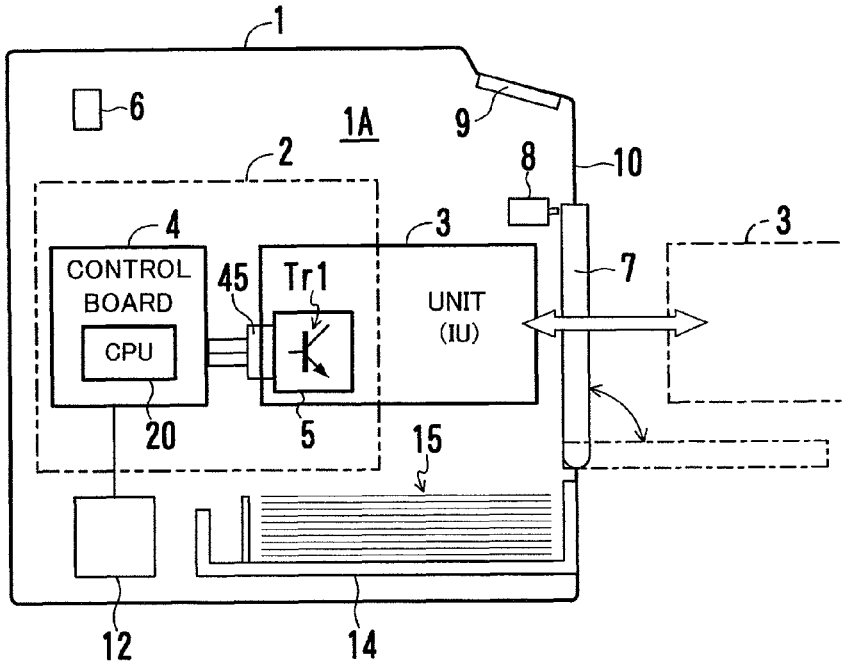
FIG. 1 is a schematic diagram showing an example of the structure of an image forming apparatus having a unit checking device according to an embodiment of the present invention.

FIG. 1 is a schematic diagram showing an example of the structure of an image forming apparatus 1 having a unit checking device 2 according to an embodiment of the present invention. The image forming apparatus 1 is a printer which forms an image by electrophotography. However, the image forming apparatus 1 is not limited to a printer. The image forming apparatus 1 may be a copier, a multi-functional device, or a facsimile machine.

The image forming apparatus 1 includes a device body 1A and a unit (functional unit) 3 which is detachably provided to the device body 1A. In this example, the unit 3 is an imaging unit (IU) in which a photoconductor and a developing unit are formed together. The device body 1A includes a housing 10 and various components fixedly provided inside the housing 10 or on the outer surface thereof. To be specific, the device body 1A includes a control board 4, a power switch 6, a cover (lid) 7, a cover sensor 8, a touch-sensitive panel display 9, a power supply circuit 12, a paper cassette 14 for holding paper 15 therein, and other mechanisms necessary for image formation, for example, a paper conveyance mechanism.

The unit 3 is attached to or detached from the device body 1A in a state where the cover 7 provided on the front face of the housing 10 is left open. For replacement of the unit 3, the user opens the cover 7 to pull out the unit 3 which is an old unit. The user then presses a unit 3 which is a new unit against the device body 1A toward the rear, and attach the new unit 3 to the device body 1A. When the new unit 3 is pushed to a predetermined position, a board 5 for checking provided in the unit 3 and the control board 4 of the device body 1A are electrically connected to each other through a connector 45. When the user finishes pushing the unit 3 to close the cover 7, fixing (attaching) the unit 3 is completed.

In a state where the unit 3 is attached to the device body 1A as describe above, the unit 3 and the device body 1A are electrically connected and mechanically coupled to each other so that the power can be supplied from the device body 1A and the rotational driving force can be transmitted from the device body 1A.

The board 5 of the unit 3 has a transistor Tr1 for checking which can be destructed by power supplied from the device body 1A. The control board 4 of the device body 1A has a Central Processing Unit (CPU) 20. The CPU 20 executes a determination process (new/old determination process) for determining whether or not the transistor Tr1 is destructed by applying a voltage to the transistor Tr1, and a destruction process for destructing the transistor Tr1, or, alternatively, gives a command to execute the determination process and the destruction process. The control board 4 is an example of an inspection device which is capable of performing the determination process and the destruction process on the transistor Tr1. Further, the control board 4 of this embodiment determines whether or not the unit 3 is attached, and determines whether or not the destination of the unit 3 attached is suitable for the device body 1A. The control board 4 and the board 5 constitute the unit checking device 2 for checking whether the unit 3 is a new unit or an old unit.

Figure 2:
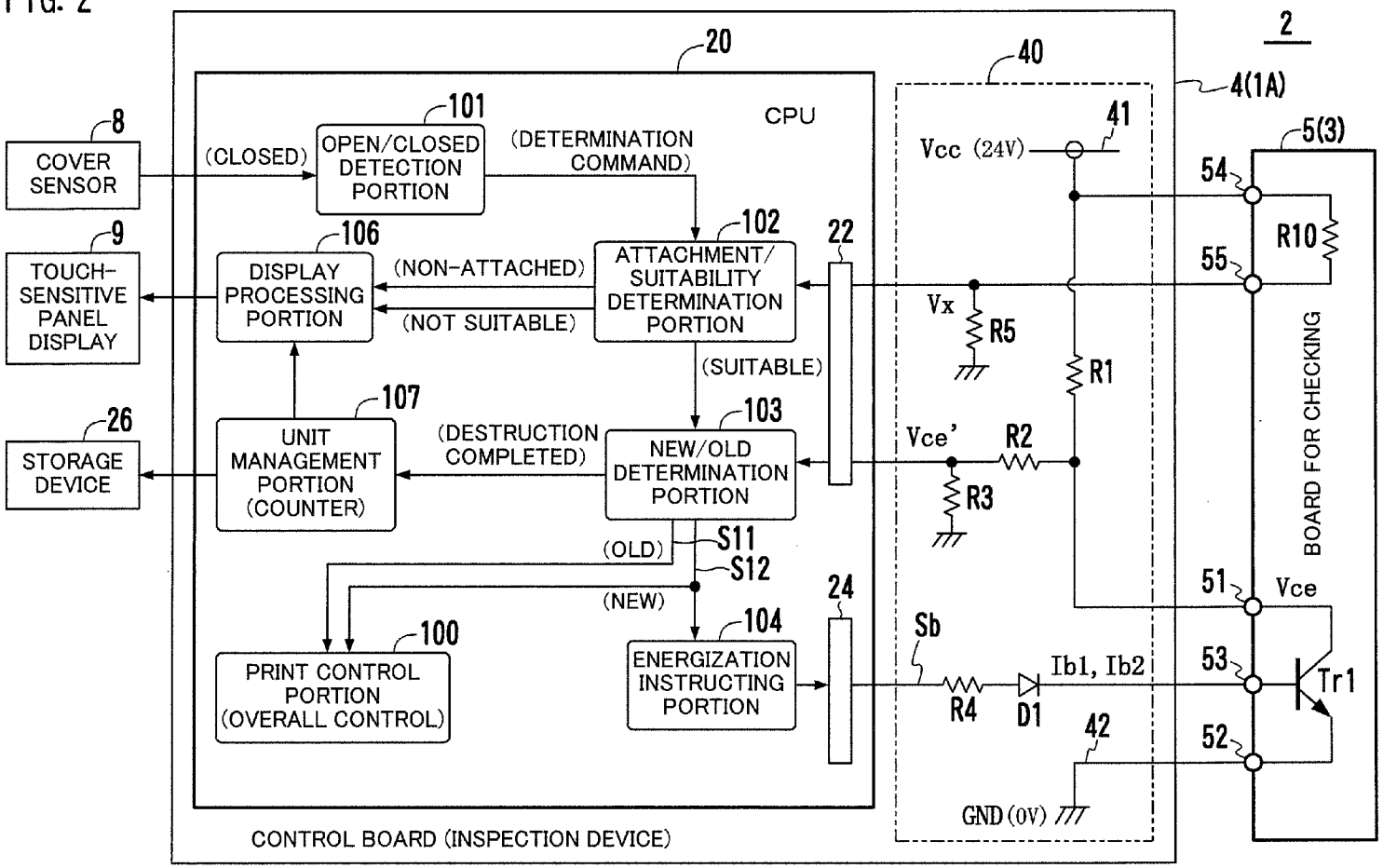
FIG. 2 is a diagram showing an example of the configuration of a unit checking device.

FIG. 2 shows an example of the configuration of the unit checking device 2. It is supposed that, in FIG. 2, the unit 3 is attached to the device body 1A, and therefore the control board 4 and the board 5 are electrically connected to each other.

The unit checking device 2 includes the board 5 for checking provided in the unit 3, and the control board 4 as the inspection device provided in the device body 1A. The control board 4 includes the CPU 20 and an input/output circuit 40. The description goes on to the configurations of the board 5 of the unit 3, the input/output circuit 40, and the CPU 20 in the stated order.

The board 5 includes the transistor Tr1 for checking new/old of the unit 3, a resistor R10 for checking destination of the unit 3, and first terminal 51 through fifth terminal 55 which are unit side terminals to connect the transistor Tr1 and the resistor R10 to the control board 4. A variety of transistors may be used as the transistor Tr1. For example, the transistor Tr1 may be a transistor for small signal amplification which is available as a general-purpose component in the market. The transistor Tr1 is an NPN transistor in the illustrated example; however, not limited thereto. The transistor Tr1 may be a PNP transistor.

On the board 5, a collector of the transistor Tr1 is connected to the first terminal 51, an emitter of the transistor Tr1 is connected to the second terminal 52, and a base of the transistor Tr1 is connected to the third terminal 53. Both ends of the resistor R10 are connected to the fourth terminal 54 and the fifth terminal 55, respectively.

Between the first terminal 51 and the second terminal 52, namely, between the collector and the emitter, a power for destructing the transistor Tr1 and a voltage for determining whether or not the transistor Tr1 is destructed are supplied from the control board 4. The third terminal 53, namely, the base, is given an energization signal for generating a base current Ib of the transistor Tr1 from the control board 4.

In the case where the specifications of the image forming apparatus 1 differ depending on destinations such as Japan, the Unites Stated, and Europe, the resistor R10 is used to determine whether or not the destination of the device body 1A accords with the destination of the unit 3. The constant of the resistance (resistance value) of the resistor R10 is set at a value depending on the destination of the unit 3.

The control board 4 includes terminals (not shown) corresponding to the terminals 51-55 of the board 5. In a state where the unit 3 is attached to the device body 1A, the transistor Tr1 and the resistor R10 of the board 5 are connected to the input/output circuit 40 of the control board 4 as shown in FIG. 2.

The input/output circuit 40 of the control board 4 includes a power supply line 41, a ground line (GND) 42, first resistor R1 through fifth resistor R5, and a diode D1.

The power supply line 41 is connected to the fourth terminal 54, and also connected to the first terminal 51 through the first resistor R1. The ground line 42 is connected to the second terminal 52. The power supply line 41 outputs a first voltage Vcc to be applied through the first resistor R1 to the collector of the transistor Tr1. The value of the voltage Vcc is, for example, 24 volts. The power supply line 41 is an example of the "first voltage output portion" recited in the present invention.

The second resistor R2 and the third resistor R3 are connected in series between the first terminal 5 and the ground line 42. Across both ends of the third resistor R3, a voltage Vce' appears which is obtained by dividing the collector voltage Vce of the transistor Tr1 to be suitable for being inputted into the CPU 20. The voltage Vce' is detected as the collector voltage Vce by the CPU 20. The voltage Vce' may be hereinafter referred to as a "collector voltage".

The fourth resistor R4 is a base resistor for limiting the base current Ib flowing through the transistor Tr1.

The diode D1 is a diode for back-flow prevention which prevents the current from flowing into the CPU 20 from the power supply line 41. An anode of the diode D1 is connected to the fourth resistor R4 while a cathode thereof is connected to the third terminal 53. In short, the diode D1 is connected to the base of the transistor Tr1 in the forward direction.

The fifth resistor R5 is connected between the fifth terminal 55 and the ground line 42. The fifth resistor R5 is an element for determining whether or not the unit 3 is attached and whether or not the destination is suitable. The resistance value of the fifth resistor R5 is set depending on destination of the device body 1A, and so on. Across both ends of the fifth resistor R5, a voltage Vx obtained by dividing the voltage Vcc by the resistor R10 of the board 5 and the fifth resistor R5 appears. The voltage Vx is detected by the CPU 20 as information representing the destination of the unit 3.

The CPU 20 controls the entirety and the individual portions of the image forming apparatus 1 in accordance with programs. The CPU 20 may be formed, for example, by an Application Specific Integrated Circuit (ASIC). The CPU 20 contains, therein, a signal input circuit 22, a signal output circuit 24, and a processor for executing the programs.

The signal input circuit 22 performs an A/D conversion on the voltage Vce' across both ends of the third resistor R3 and on the voltage Vx across both ends of the fifth resistor R5, and outputs the resultants as detection values of the voltage Vce' and the voltage VX. The signal input circuit 22 is an example of a voltage detection portion for detecting the collector voltage Vce of the transistor Tr1.

The signal output circuit 24 is an example of an energization signal output portion for outputting an energization signal Sb for generating a base current Ib of the transistor Tr1. The signal output circuit 24 outputs, to the fourth resistor R4, an energization signal Sb which is a voltage signal obtained by performing the D/A conversion on a command value given by an energization instructing portion 104 described later. The signal output circuit 24 can change the base current Ib by changing the magnitude of the energization signal Sb.

When the control board 4 performs the destruction process, the signal output circuit 24 outputs, for a first time TA or longer, the energization signal Sb having a magnitude which enables the transistor Tr1 to be in a non-saturated state while the voltage Vcc of the power supply line 41 is outputted to the board 5. The energization signal Sb is fed into the base of the transistor Tr1 through the fourth resistor R4 and the diode D1.

While the transistor Tr1 is in the non-saturated state, a collector dissipation, which is the product of the collector voltage and the collector current, is large. This generates heat, which raises the temperature of the transistor Tr1. The continuation of this state for the first time TA or longer leads to destruction of the transistor Tr1.

When the control board 4 performs the destruction process, the signal output circuit 24 varies the magnitude of the energization signal Sb. When a collector dissipation Pc of the transistor Tr1 obtained based on the collector voltage Vce' detected by the signal input circuit 22 reaches a predetermined value or more, for example, when the collector dissipation Pc exceeds the maximum collector dissipation Pcmax, or, when the collector dissipation Pc exceeds a predetermined multiple of the maximum collector dissipation Pcmax, the signal output circuit 24 may perform control in such a manner that the magnitude of the energization signal Sb is fixed.

When the control board 4 performs the destruction process, the signal output circuit 24 outputs, for a second time TB, the energization signal Sb having a magnitude which enables the transistor Tr1 to be in a non-saturated state. After that, in the case where a new/old determination portion 103, described later, does not determine that the transistor Tr1 is destructed, the signal output circuit 24 may output again the energization signal Sb for the second time TB. This may be repeated.

The CPU 20 is configured of, as functional elements related to the unit checking device 2, an open/closed detection portion 101, an attachment/suitability determination portion 102, the new/old determination portion 103, an energization instructing portion 104, a display processing portion 106, a unit management portion 107, and so on. The CPU 20 also includes a print control portion 100 as a functional element related to the entire control on the image forming apparatus 1. The functional elements are implemented in response to execution of a predetermined program by a processor built in the CPU 20.

The open/closed detection portion 101 detects an open/closed state of the cover 7 based on an output from the cover sensor 8. When detecting that cover 7 turns from the open state to the closed state, the open/closed detection portion 101 instructs the attachment/suitability determination portion 102 and the new/old determination portion 103 to execute the determination process. Likewise, when the power switch 6 is turned ON to supply power from the power supply circuit 12 to the CPU 20 to start up the CPU 20, the open/closed detection portion 101 also instructs the attachment/suitability determination portion 102 to execute the determination process.

The attachment/suitability determination portion 102 determines, based on the voltage Vx of the fifth resistor R5 detected by the signal input circuit 22, whether or not the unit 3 is attached (mounted), and whether or not the destination is suitable. If the voltage Vx has a value of 0 (zero), then the attachment/suitability determination portion 102 determines that no unit 3 is attached. If the voltage Vx has a predetermined value (≠0 (zero)) depending on the destination of the device body 1A, then the attachment/suitability determination portion 102 determines that the destination is suitable. If the voltage Vx has a value which is neither 0 (zero) nor the predetermined value, then the attachment/suitability determination portion 102 determines that the destination is not suitable.

When the result of determination is "non-attached" and when the result of determination is "not suitable", the results are given to the display processing portion 106. In such a case, the display processing portion 106 performs a process for displaying an error message on the touch-sensitive panel display 9, etc.

When the result of determination is "suitable", the attachment/suitability determination portion 102 informs the new/old determination portion 103 of the result. In such a case, the new/old determination portion 103 and the energization instructing portion 104 work in coordination to perform the determination process for checking whether the unit 3 is new or old.

The new/old determination portion 103 is an example of a determination portion which determines, based on the collector voltage Vce' detected by the signal input circuit 22, whether or not the transistor Tr1 is destructed. The signal output circuit 24 outputs an energization signal Sb so that the transistor Tr1 turns into a saturated state at a time when the new/old determination portion 103 performs the determination process.

Figure 3:
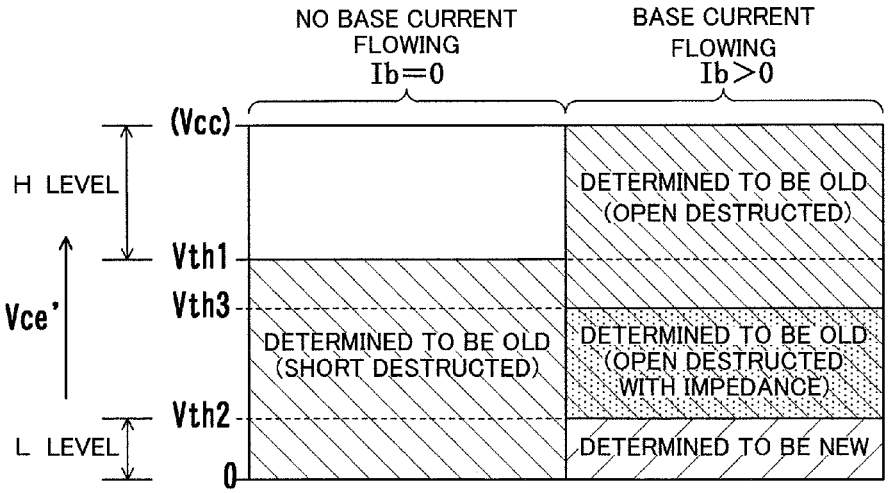
FIG. 3 is a diagram showing an example of the relationship between new/old of a unit in a determination process and a threshold.

FIG. 3 shows an example of the relationship between new/old of the unit 3 in the determination process and thresholds Vth1, Vth2, and Vth3.

Referring to FIGS. 2 and 3, when no energization signal Sb is outputted (the base current Ib is 0 (zero)), and further, when the collector voltage Vce' is smaller than the first threshold Vth1, the new/old determination portion 103 determines that the transistor Tr1 is destructed (short destructed). In such a case, the new/old determination portion 103 outputs a detection signal S11 representing that the unit 3 is old to the print control portion 100. The print control portion 100 determines, through the detection signal S11, that the unit 3 has not just been attached for replacement, and omits, for example, an initial adjustment process to be performed when the unit 3 has just been replaced with an old unit.

The first threshold Vth1 is a value of a divided voltage to be produced across both ends of the third resistor R3 at a time when a voltage Vcc is applied to a series circuit of the first resistor R1 though the third resistor R3. To be specific, the first threshold Vth1 is set to be a minimum value within a range of variations in the divided voltage calculated in light of variations in resistance value. Hereinafter, a range between the first threshold Vth1 and the value of the voltage Vcc (24V) is sometimes referred to as an "H level".

When the energization signal Sb for turning the transistor Tr1 into a saturated state (Ib>0 (zero)) is outputted, and further, when the collector voltage Vce' has a value equal to or greater than a second threshold Vth2, the new/old determination portion 103 determines that the transistor Tr1 is destructed (open destructed). In such a case, the new/old determination portion 103 outputs, as the check result, the detection signal S11 representing that the unit 3 is old to the print control portion 100.

The second threshold Vth2 is a value of a voltage to be produced across both ends of the third resistor R3 at a time when the transistor Tr1 operates normally. The collector voltage Vce of the transistor Tr1 operating normally corresponds to a voltage which drops due to ON-resistance of the transistor Tr1. The second threshold Vth2 is a value which is smaller than the first threshold Vth1 and is close to 0 (zero). Hereinafter, a range between 0 (zero) and the second threshold Vth2 may be referred to as an "L level".

When the energization signal Sb for turning the transistor Tr1 into a saturated state (Ib>0 (zero)) is outputted, and further, when the collector voltage Vce' is smaller than the second threshold Vth2, the new/old determination portion 103 determines that the transistor Tr1 is not destructed. In such a case, the new/old determination portion 103 outputs, as the check result, a detection signal S12 representing that the unit 3 is new to the print control portion 100. Thereafter, at an appropriate time, the new/old determination portion 103 outputs, as a destruction command, the detection signal S12 to the energization instructing portion 104.

When the energization signal Sb for turning the transistor Tr1 into a saturated state is outputted, further, when the collector voltage Vce' is equal to or greater than the second threshold Vth2, and furthermore, when the collector voltage Vce' is smaller than a third threshold Vth3 which is greater than the second threshold Vth2 and is equal to or smaller than the first threshold Vth1, the new/old determination portion 103 determines that the transistor Tr1 is destructed with an impedance. This is also one aspect of the open destruction. This may be called an "open destruction with impedance".

The "open destruction with impedance" corresponds to a state in which the collector voltage Vce' has a value smaller than the third threshold Vth3 as described above. Instead of this, the "open destruction with impedance" may correspond to a state in which the collector voltage Vce' has a value smaller than the first threshold Vth1. Stated differently, the third threshold Vth3 may be made the same as the first threshold Vth1.

The new/old determination portion 103 determines whether or not the transistor Tr1 is destructed also when the energization signal Sb for turning the transistor Tr1 into a non-saturated state is outputted, namely, when the destruction process is performed. When determining that the transistor Tr1 is destructed, the new/old determination portion 103 informs the unit management portion 107 of the completion of the destruction process.

In the saturated state of the transistor Tr1, the collector voltage Vce is usually one volt or lower. Consequently, a change in collector current is not proportional to a change in base current Ib, so that the substantial current amplification factor is greatly reduced. This is a state in which the switch is turned ON in switching operation. In such a case, since the collector voltage Vce is low, the collector dissipation is small and no thermal destruction occurs. The values of the maximum collector dissipation Pcmax of the transistor Tr1, the first voltage Vcc, the first resistor R1, and so on are so selected that no thermal destruction occurs in the transistor Tr1 in the saturated state.

In the non-saturated state of the transistor Tr1, the collector voltage Vce is usually a value corresponding to approximately 20-80% of the voltage Vcc in the power supply line 41, for example, approximately 50% thereof. Consequently, a change in collector current is proportional to a change in base current Ib with a current amplification factor β used as a constant of proportion. In such a case, the collector voltage Vce is high, and the collector current is also a significant value. The collector dissipation obtained by multiplying the collector voltage Vce and the collector current is large. This state continues for a predetermined time, which causes a thermal destruction. The values of the maximum collector dissipation Pcmax of the transistor Tr1, the first voltage Vcc, and the first resistor R1, the first time TA, and so on are so selected that a thermal destruction occurs in the transistor Tr1 in the non-saturated state. The first time TA may be selected, for example, to be a value within a range of 0.5 seconds to a few seconds.

The saturated state may be described as a state where a transistor is present in a saturated region. The non-saturated state may be described as a state where a transistor is present in an active region.

The unit management portion 107 operates as a counter to count the number of times when the unit 3 has been used. The count value is stored in the non-volatile storage device 26. If a non-volatile memory is provided in the CPU 20 or on the control board 4, the non-volatile memory may be used to store the count value.

When the count value of the counter reaches a predetermined value, the unit management portion 107 gives the display processing portion 106 a command to display a message which prompts replacement of the unit 3. The unit 3 is replaced with a new unit and the control board 4 performs a destruction process on the transistor Tr1 of the new unit just attached. Immediately thereafter, the unit management portion 107 is given a notice of the completion of the destruction process by the new/old determination portion 103. At this time, the unit management portion 107 resets the count value stored.

The description goes on to the operation of the unit checking device with reference to flowcharts.

Figure 4:
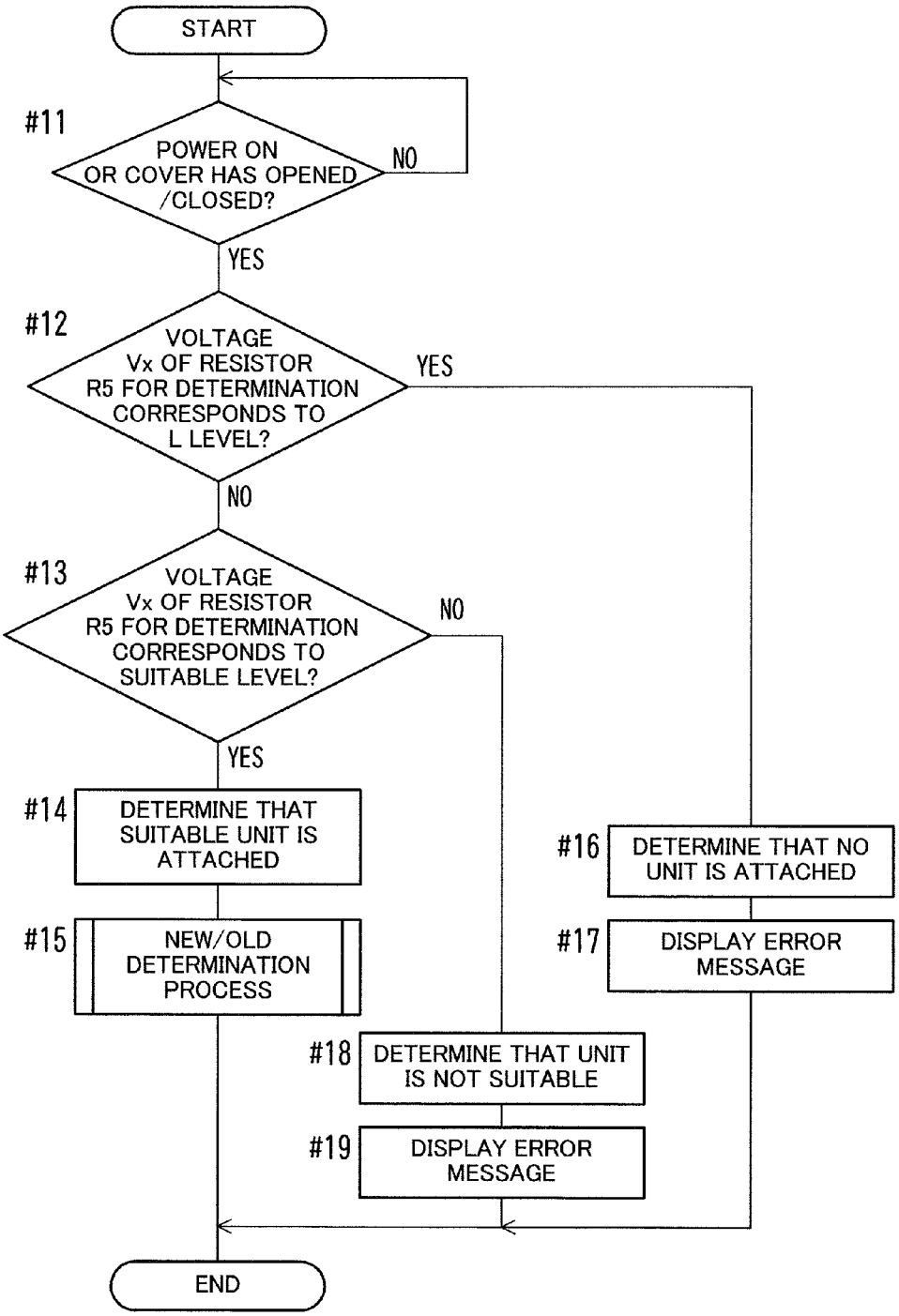
FIG. 4 is a flowchart for depicting an example of the flow of operation of a unit checking device.
Figure 5:
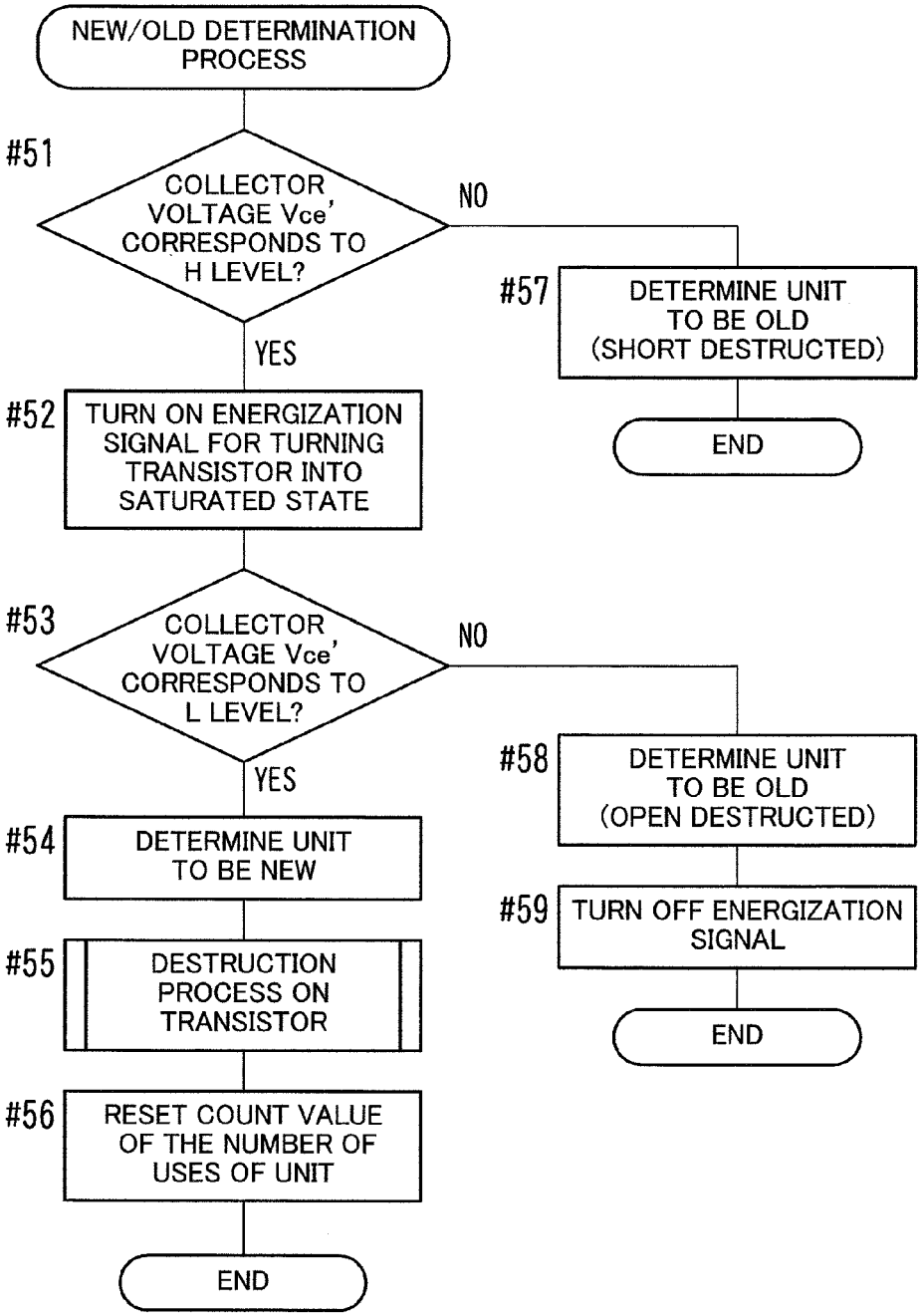
FIG. 5 is a flowchart for depicting an example of the flow of a determination process.
Figure 6:
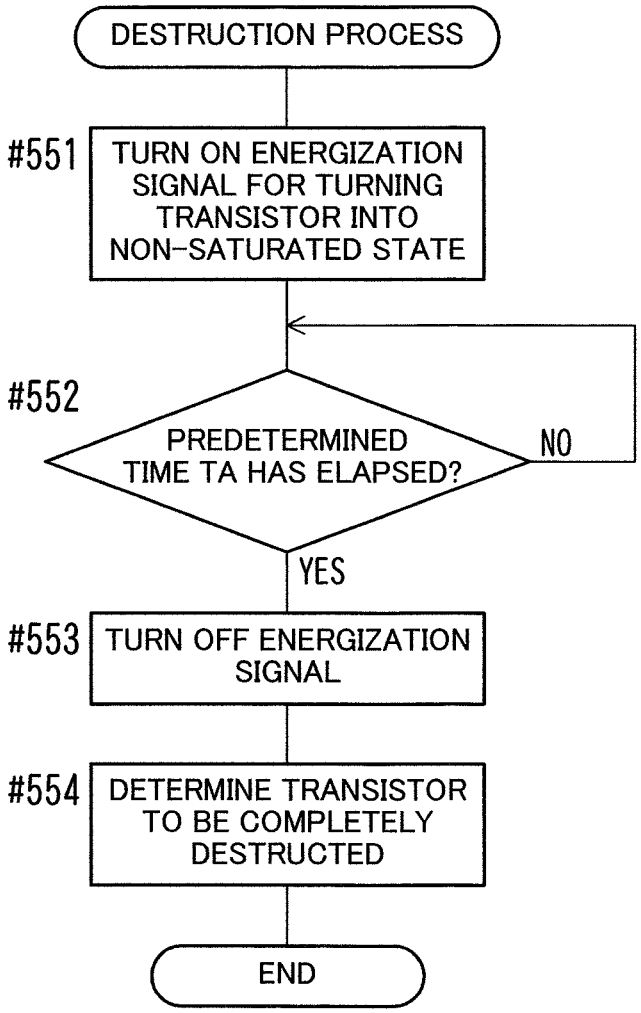
FIG. 6 is a flowchart for depicting an example of the flow of a destruction process on a transistor.
Figure 7:
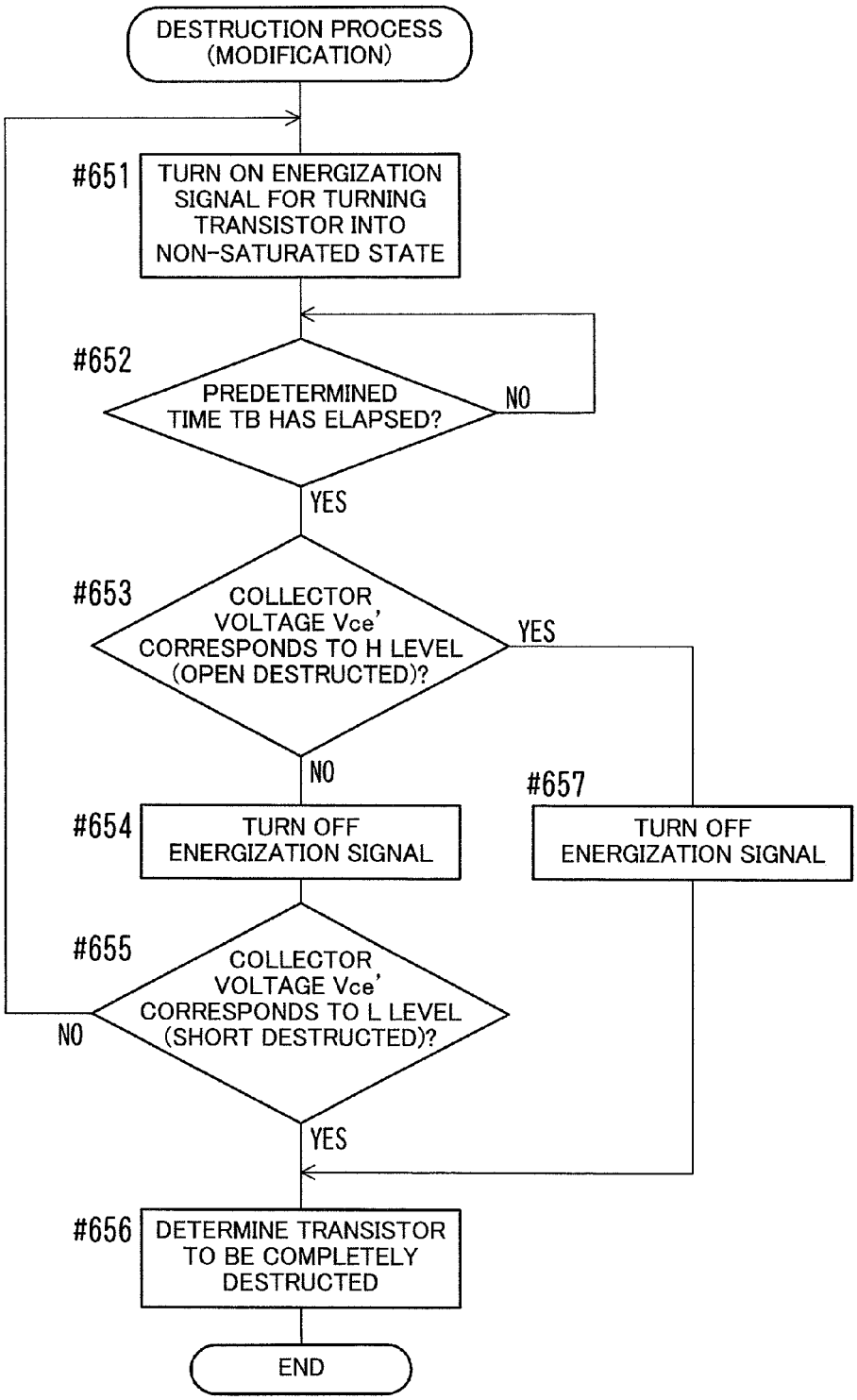
FIG. 7 is a flowchart for depicting another example of the flow of a destruction process on a transistor.

FIG. 4 depicts an example of the flow of operation of a unit checking device; FIG. 5 depicts an example of the flow of a determination process; FIG. 6 depicts an example of the flow of a destruction process on a transistor; and FIG. 7 depicts another example of the flow of the destruction process on the transistor.

Referring to FIG. 4, the open/closed detection portion 101 (see FIG. 2) checks whether it is immediately after the power of the device body 1A is turned ON, or, alternatively, it is immediately after the cover 7 turns from the open state into the closed state with the device body 1A turned ON (Step #11).

If the result of check is "YES" in Step #11, then the attachment/suitability determination portion 102 checks whether or not the voltage Vx of the fifth resistor R5 for determination corresponds to the L level (Step #12). If the voltage Vx corresponds to the L level (YES in Step #12), then the attachment/suitability determination portion 102 determines that no unit 3 is attached (Step #16), and the display processing portion 106 is caused to display a predetermined error message (Step #17).

If the voltage Vx does not correspond to the L level (NO in Step #12), then the attachment/suitability determination portion 102 checks whether or not the voltage Vx falls within a predetermined appropriate level for the destination of the device body 1A (Step #13). If the voltage Vx does not correspond to the predetermined appropriate level (NO in Step #13), in other words, if a unit corresponding to a destination different from that of the device body 1A is attached, then the attachment/suitability determination portion 102 determines that the unit 3 is not suitable (Step #18), and causes the display processing portion 106 to display a predetermined error message (Step #19).

On the other hand, if the voltage Vx corresponds to the predetermined appropriate level (YES in Step #13), then the attachment/suitability determination portion 102 determines that the unit 3 is suitable for the destination of the device body 1A (Step #14). In such a case, the CPU 20 executes a determination process (new/old determination process) (Step #15).

Referring to FIG. 5, the new/old determination portion 103 checks whether or not the collector voltage Vce' corresponds to the H level without outputting an energization signal Sb (Step #51). In other words, the new/old determination portion 103 checks whether or not the collector voltage Vce' is equal to or greater than the first threshold Vth1 with the transistor Tr1 remaining OFF.

If the result of check in Step #51 is NO, then the new/old determination portion 103 determines that the transistor Tr1 of the unit 3 is shorted out and destructed, and determines that the unit 3 is old (Step #57).

If the result of check in Step #51 is YES, then the new/old determination portion 103 requests the energization instructing portion 104 to operate the transistor Tr1 for new/old determination. In response to the request, the energization instructing portion 104 gives the signal output circuit 24 a predetermined command value to output (turn ON) an energization signal Sb having a magnitude which enables the transistor Tr1 to be in a saturated state (Step #52).

In a state where the energization signal Sb for making the transistor Tr1 be in the saturated state, the new/old determination portion 103 checks whether or not the collector voltage Vce' corresponds to the L level, namely, is smaller than the second threshold Vth2 (Step #53).

If the result of check in Step #53 is NO, then the new/old determination portion 103 determines that the transistor Tr1 is open destroyed, and determines that the unit 3 is old (Step #58). In such a case, the energization instructing portion 104 instructs the signal output circuit 24 to stop outputting (turn OFF) the energization signal Sb (Step #59).

If the result of check in Step #53 is YES, then the new/old determination portion 103 determines that the transistor Tr1 is not destructed, and determines that the unit 3 is new (Step #54). In such a case, the destruction process is performed on the transistor Tr1 (Step #55). After the completion of the destruction process, the unit management portion 107 resets the count value of the number of uses of the unit 3 (Step #56).

In the example of the destruction process of FIG. 6, when determining that the unit 3 is new, the new/old determination portion 103 requests the energization instructing portion 104 to destruct the transistor Tr1. In response to the request, the energization instructing portion 104 gives the signal output circuit 24 a predetermined command value to output (turn ON) an energization signal Sb having a magnitude which enables the transistor Tr1 to be in a non-saturated state (Step #551).

The energization instructing portion 104 waits for the predetermined first time TA to elapse since the energization signal Sb was turned ON (Step #552).

After the first time TA has elapsed (YES in Step #552), the energization instructing portion 104 instructs the signal output circuit 24 to turn OFF the energization signal Sb (Step #553). The new/old determination portion 103 then determines that the transistor Tr1 is completely destructed (Step #554).

As with the example of FIG. 6, referring to the destruction process of FIG. 7, when determining that the unit 3 is new, the new/old determination portion 103 requests the energization instructing portion 104 to destruct the transistor Tr1. In response to the request, the energization instructing portion 104 gives the signal output circuit 24 a predetermined command value to output (turn ON) the energization signal Sb having a magnitude which enables the transistor Tr1 to be in a non-saturated state (Step #651).

The energization instructing portion 104 waits for the predetermined second time TB to elapse since the energization signal Sb was turned ON (Step #652). The second time TB is equal to or longer than a time which is presumed to be necessary for the junction temperature of the transistor Tr1 to exceed a maximum rating. The second time TB may be shorter than the first time TA and may be equal to the first time TA.

After the second time TA has elapsed (YES in Step 652), the new/old determination portion 103 checks whether or not the transistor Tr1 is destructed actually in the following manner.

First, with the energization signal Sb remaining outputted, the new/old determination portion 103 checks whether or not the collector voltage Vce' corresponds to the H level, namely, whether or not the transistor Tr1 is open destructed (Step #653). If the check result is YES, then the energization instructing portion 104 instructs the signal output circuit 24 to turn OFF the energization signal Sb (Step #657). The new/old determination portion 103 then determines that destruction of the transistor Tr1 is completed (Step #656).

If the result of check in Step #653 is NO, then the energization instructing portion 104 instructs the signal output circuit 24 to turn OFF the energization signal Sb (Step #654). With the energization signal Sb turned OFF, the new/old determination portion 103 checks whether or not the collector voltage Vce' corresponds to the L level, namely, whether or not the transistor Tr1 is shorted out and destructed (Step #655). If the check result is YES, then the new/old determination portion 103 determines that destruction of the transistor Tr1 is completed (Step #656).

If the check result in Step #655 is NO, then the process goes back to Step #651. The process of Step #651 through Step #655 is repeated until the transistor Tr1 is destructed.

Figure 8:
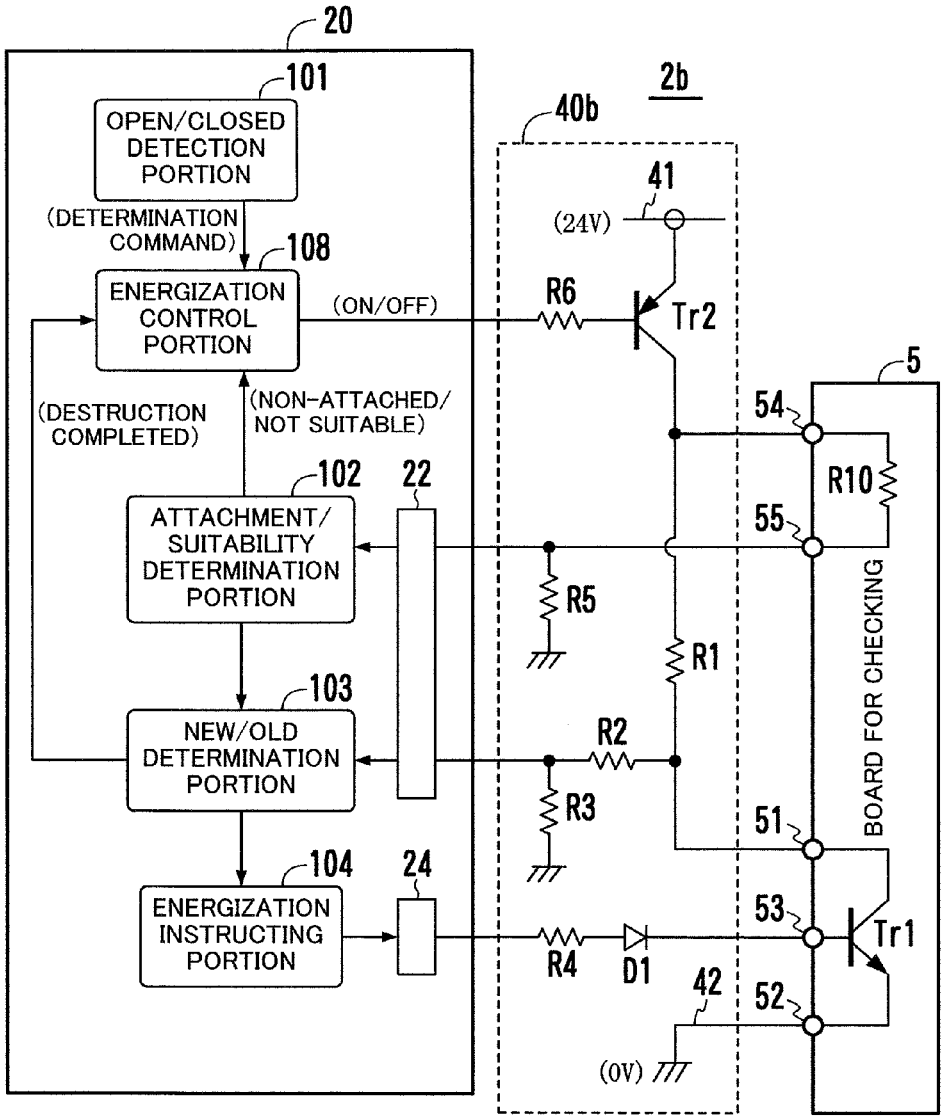
FIG. 8 is a diagram showing a modification of the configuration of a unit checking device.

FIG. 8 shows a modification of the configuration of the unit checking device 2.

As shown in FIG. 8, the configuration of a unit checking device 2*b* is basically the same as that of the unit checking device 2 of FIG. 2. The unit checking device 2*b* is characterized in that: an input/output circuit 40*b* on the control board 4 has a transistor Tr2 and a sixth resistor R6; and the CPU 20 has an energization control portion 108.

The transistor Tr2 is a PNP transistor. The transistor Tr2 functions as a switching element for turning ON or OFF the voltage Vcc supplied from the power supply circuit 12. The transistor Tr2 is provided on the power supply line 41 in such a manner that the inter emitter/collector of the transistor Tr2 is interposed between the power supply line 41 and the first resistor R1.

The transistor Tr2 is turned ON/OFF in accordance with a control signal from the energization control portion 108. The control signal is fed into the base through the sixth resistor R6.

The energization control portion 108 turns ON the transistor Tr2 only when the control board 4 performs a determination operation or a destruction operation. To be specific, when receiving a command to execute determination outputted from the open/closed detection portion 101, the energization control portion 108 turns ON the transistor Tr2. The energization control portion 108 turns OFF the transistor Tr2 when the new/old determination portion 103 determines that the unit 3 is old based on the collector voltage Vce', or, alternatively, when the new/old determination portion 103 determines that the unit 3 is new and then determines that destruction of the transistor Tr1 is completed. This arrangement reduces the power consumption while the unit checking device 2*b* is not operated.

Figure 9:
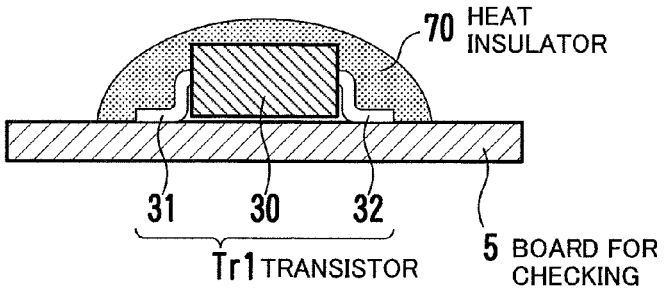
FIG. 9 is a cross-section view showing an example of the structure in which a transistor is mounted on a board for checking.
Figure 10:
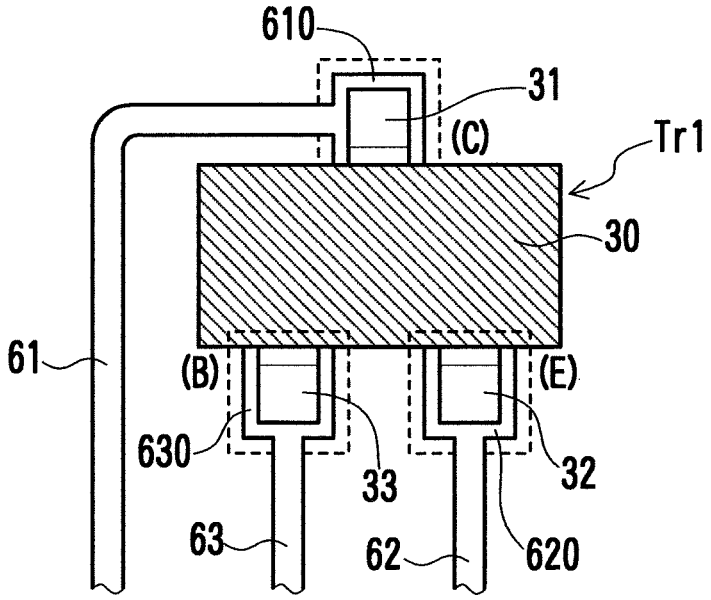
FIG. 10 is a diagram showing an example of a wiring pattern according to mounting of the transistor.

FIG. 9 shows an example of the structure in which the transistor Tr1 is mounted on the board 5 for checking; and FIG. 10 shows an example of a wiring pattern according to mounting of the transistor.

Referring to FIG. 9, the transistor Tr1 is a surface-mounted transistor. The transistor Tr1 includes a resin mold 30 for covering a transistor chip, and leads 31 and 32 led out to the resin mold 30 from the vicinity of the transistor chip.

On the board 5 for checking, the transistor Tr1 is mounted, and a heat insulator 70 is applied onto and around the transistor Tr1 to prevent the heat radiation from the transistor Tr1. The heat insulator 70 prevents the heat radiation to the atmosphere, so that the transistor Tr1 is easily destructed. The heat insulator 70 may be a silicone material (silicone rubber, for example). The heat insulator 70 may be provided between the resin mold 30 and the board 5.

Referring to FIG. 10, the transistor Tr1 includes the leads 31, 32, and 33 which correspond to the collector, the emitter, and the base thereof, respectively. The leads 31, 32, and 33 are soldered on lands (wide parts) 610, 620, and 630 of wiring patterns 61, 62, and 63 respectively on the board 5. The lands 610, 620, and 630 are formed to have a size smaller than a size which is generally recommended and denoted by dashed lines. The lands 610, 620, and 630 are made to be as small as possible to a minimum size necessary for soldering or close thereto. This reduces heat release to the board 5, so that the transistor Tr1 can be easily destructed.

According to the foregoing embodiment, when the transistor Tr1 of the unit 3 is destructed, it is possible to control the base current to control the collector current which is related to heat generation. Stated differently, the element having a small current capacity is used to control destruction. As compared to a conventional technology in which the element having a large current capacity is required, space-saving of the circuit board is implemented in the device body 1A. Elements for controlling destruction are integrated and the number of external components is reduced. This reduces the cost of the circuit board.

As discussed above, it is possible to reduce a current capacity of an element necessary to control energization for checking whether a unit is new or old. This saves a space for the circuit board of the device body.

The forgoing embodiment takes examples of the unit checking devices 2 and 2*b* of the image forming apparatus 1. The present invention is applicable to a device other than the image forming apparatus, provided that the device includes a detachable unit.

It is to be understood that the circuit configurations of the unit checking devices 2 and 2*b*, the constant of resistance, the thresholds Vth1, Vth2, and Vth3, the flow of control, and the like can be appropriately modified without departing from the spirit of the present invention.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A unit checking device for checking whether a unit detachably provided to a device body is new or old, the unit checking device comprising:

a transistor for checking provided in the unit and configured to be destructed by power supplied from the device body; and an inspection device provided in the device body and configured to determine whether or not the transistor is destructed by applying a voltage to the transistor.

2. The unit checking device according to claim 1, wherein the inspection device includes a first voltage output portion configured to output a first voltage to be applied through a first resistor to a collector of the transistor, an energization signal output portion configured to output an energization signal for generating a base current of the transistor, a voltage detection portion configured to detect a collector voltage of the transistor, and a determination portion configured to make a determination as to whether or not the transistor is destructed based on the collector voltage detected by the voltage detection portion, and when the determination portion makes the determination, the energization signal output portion outputs the energization signal to enable the transistor to turn into a saturated state.

3. The unit checking device according to claim 2, wherein when the energization signal is not outputted, and further, when the collector voltage is smaller than a first threshold, the determination portion determines that the transistor is destructed and outputs a detection signal representing that the unit is old, when the energization signal for turning the transistor into a saturated state is outputted, and further, when the collector voltage is equal to or greater than a second threshold, the determination portion determines that the transistor is destructed and outputs a detection signal representing that the unit is old, and when the energization signal for turning the transistor into a saturated state is outputted, and further, when the collector voltage is smaller than the second threshold, the determination portion determines that the transistor is not destructed and outputs a detection signal representing that the unit is new.

4. The unit checking device according to claim 3, wherein, when the energization signal for turning the transistor into a saturated state is outputted, further, when the collector voltage is equal to or greater than the second threshold, and furthermore, when the collector voltage is smaller than a third threshold which is greater than the second threshold and is equal to or smaller than the first threshold, the determination portion determines that the transistor is destructed with an impedance.

5. The unit checking device according to claim 2, wherein the inspection device is configured to perform determination operation for determining whether or not the transistor is destructed, and destruction operation for destructing the transistor, the energization signal output portion is configured to change the base current by changing a magnitude of the energization signal, and when the destruction operation is performed, the energization signal output portion outputs, for a first time or longer, the energization signal having a magnitude which enables the transistor to be in a non-saturated state while the first voltage is outputted.

6. The unit checking device according to claim 5, wherein, when the destruction operation is performed, the energization signal output portion changes a magnitude of the energization signal, and when a collector dissipation of the transistor obtained based on the collector voltage detected by the voltage detection portion reaches a predetermined value or more, the energization signal output portion fixes the magnitude of the energization signal.

7. The unit checking device according to claim 5, wherein the device body is provided with a counter configured to count a number of times when the unit has been used, the counter is reset immediately after the destruction operation is performed, and when a count value of the counter reaches a predetermined value, a message is displayed which prompts replacement of the unit.

8. The unit checking device according to claim 5, wherein the first voltage output portion is provided with a switching element for turning ON or OFF the first voltage supplied from a power supply, and the switching element is turned ON only when the determination operation or the destruction operation is performed.

9. The unit checking device according to claim 2, wherein the inspection device is configured to perform determination operation for determining whether or not the transistor is destructed, and destruction operation for destructing the transistor, the energization signal output portion is configured to change the base current by changing a magnitude of the energization signal, and when the destruction operation is performed, the energization signal output portion outputs, for a second time, the energization signal having a magnitude which enables the transistor to be in a non-saturated state, and after that, when the determination portion does not determine that the transistor is destructed, the energization signal output portion outputs again, for the second time, the energization signal, and repeats the process.

10. The unit checking device according to claim 2, wherein the device body includes a cover configured to be opened and closed when the unit attached to the device body is replaced, and an open and closed detection portion configured to detect an open and closed state of the cover, and the determination portion makes the determination when the cover turns from an open state to a closed state, or, alternatively, when a power supply of the device body is turned on.

11. The unit checking device according to claim 2, wherein a diode is connected to a base of the transistor in a forward direction, and the energization signal is inputted to the base of the transistor through the diode.

12. The unit checking device according to claim 2, wherein, a heat insulator is provided in a vicinity of the transistor to prevent heat release from the transistor.

13. The unit checking device according to claim 12, wherein the heat insulator is a silicone material.

14. An image forming apparatus comprising:

a device body configured to form an image onto paper by electrophotography;

a unit detachably provided to the device body; and a unit checking device according to claim 1.

15. A unit detachably provided to a device body and checkable as new or old, the unit comprising:

a transistor for checking configured to be destructed by power supplied from the device body; and unit side terminals configured to connect, when the unit is attached to the device body, an emitter, a collector, and a base of the transistor to device body side terminals of the device body.

16. A unit checking method for checking whether a unit detachably provided to a device body is new or old, the unit checking method comprising:

providing, in the unit, a transistor for checking configured to be destructed by power supplied from the device body; and with the unit attached to the device body, applying, by an inspection device of the device body, a base current to enable the transistor to turn into a saturated state with a voltage supplied to a collector of the transistor through a resistor, detecting a collector voltage, and determining whether or not the transistor is destructed based on the collector voltage.

* * * * *